US009399811B2

(12) United States Patent
Schwarzer et al.

(10) Patent No.: US 9,399,811 B2
(45) Date of Patent: Jul. 26, 2016

(54) METHOD FOR CARBONITRIDING AT LEAST ONE COMPONENT IN A TREATMENT CHAMBER

(75) Inventors: Jochen Schwarzer, Witten (DE); Thomas Waldenmaier, Freiberg/Neckar (DE); Lazlo Hagymasi, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 794 days.

(21) Appl. No.: 13/579,103

(22) PCT Filed: Jan. 3, 2011

(86) PCT No.: PCT/EP2011/050025

§ 371 (c)(1), (2), (4) Date: Oct. 29, 2012

(87) PCT Pub. No.: WO2011/098306

PCT Pub. Date: Aug. 18, 2011

(65) Prior Publication Data

US 2013/0037173 A1 Feb. 14, 2013

(30) Foreign Application Priority Data

Feb. 15, 2010 (DE) ..... 10 2010 001 936

(51) Int. Cl.
*C23C 8/30* (2006.01)
*C23C 8/32* (2006.01)
*C23C 8/34* (2006.01)

(52) U.S. Cl.
CPC ... *C23C 8/30* (2013.01); *C23C 8/32* (2013.01); *C23C 8/34* (2013.01)

(58) Field of Classification Search
CPC ..... C23C 8/30; C23C 8/32; C23C 8/34
See application file for complete search history.

(56) References Cited

U.S. PATENT DOCUMENTS 5,273,585 A * 12/1993 Shoga et al. ..... 118/719
7,357,843 B2 * 4/2008 Yamaguchi et al. ..... 148/223
2002/0134467 A1 * 9/2002 Kawata et al. ..... 148/215
2002/0166607 A1 11/2002 Altena et al.
2004/0250921 A1 * 12/2004 Yamaguchi ..... 148/218

FOREIGN PATENT DOCUMENTS

| | | |
|---|---|---|
| DE | 3937699 | 5/1991 |
| DE | 4211395 | 10/1993 |
| DE | 19644051 | 5/1998 |
| DE | 19909694 | 9/2000 |
| DE | 10118494 | 10/2002 |
| DE | 10322255 | 12/2004 |
| EP | 909951 | 4/1999 |
| WO | 0155471 | 8/2001 |

OTHER PUBLICATIONS

Gräfen, Winfried, and Bernd Edenhofer. "New developments in thermo-chemical diffusion processes." Surface and Coatings Technology 200.5 (2005): 1830-1836.*

Database Comendex [Online] Engineering Information,Inc., New York, NY, US; 2005 Joritz D et al: "Controlled gasnitriding and nitrocarburizging in fully automatic retort furnaces," XP002622503.

PCT/EP2011/050025 International Search Report dated Mar. 7, 2011 (Translation and Original, 6 pages).

Sporge, et al., "Analyse und Steuerung von Nitrier- und Nitrocarburierathmosphare," HTM, 52, 1997, pp. 28-31.

Lohrmann, "Improved Nitriding and Nirtocaburising Atmosphere Control with the HydroNit Sensor," Heat Treatment of Metals, 2001, pp. 53-55.

* cited by examiner

*Primary Examiner* — Jessee Roe
(74) *Attorney, Agent, or Firm* — Michael Best & Friedrich LLP

(57) ABSTRACT

The invention relates to a method for carbonitriding at least one component (12) in a treatment chamber (16), in which at least one process gas (28; 30) is introduced into the treatment chamber (16), wherein a hydrogen content (44) is detected in an atmosphere developing in the treatment chamber (16) and is maintained in a desired range (55; 57) at least at intervals by influencing of the amount of the process gas (28; 30) that is fed.

10 Claims, 3 Drawing Sheets

METHOD FOR CARBONITRIDING AT LEAST ONE COMPONENT IN A TREATMENT CHAMBER

BACKGROUND OF THE INVENTION

The invention relates to a method for carbonitriding at least one component in a treatment chamber, in which at least one process gas is introduced into the treatment chamber as well as to a treatment chamber and an open-loop and/or closed loop control device for such a treatment chamber.

Methods for carbonitriding metal components are known from the German patent publications DE 199 09 694 A1, DE 101 18 494 A1 and DE 103 22 255 A1. Carbonitriding of metal components is a thermochemical process, in which carbon and nitrogen are introduced into the surface layer of an iron-based material. It is a particular kind of "case hardening". The German patent publication DE 199 09 694 A1 describes a carbonitriding method, in which the diffusion of nitrogen occurs during the entire process or when using nitrogen as the donating gas preferably in the last process phase. The German patent publication DE 101 18 494 C2 describes a low-pressure carbonitriding method, in which steel components are initially carburized and subsequently nitrided with a nitrogen-donating gas. The German patent publication DE 103 22 255 A1 describes a method for carburizing steel components, in which nitrogen producing gas is added during the heating-up phase as well as during the diffusion phase. The nitrogen diffused during carbonitriding leads to an improved resistance to wear due to friction and to an improved resistance to tempering in the surface layer.

The process control during carbonitriding takes place in at least one treatment chamber by the presetting of pressure, temperature, time, process gas composition and process gas flow volume. During carbonitriding, molecular hydrogen can develop as a by-product from the carbon-donating and nitrogen-donating gases. The hydrogen content can be detected by suitable sensors. The sensors being used must be designed for use in low-pressure or vacuum systems.

In conventional gas-nitriding processes, commercially available hydrogen sensors allow for the control of the process gas atmosphere with the aid of the nitriding index. The nitriding index is defined as follows:

$$k_N = p_{NH3}(p_{H2})^{1.5}, \text{ wherein}$$

$k_N$=Nitriding index $P_{NH3}$=Pressure of the ammonia, and $P_{H2}$=Pressure of the hydrogen, and describes the relationship between ammonia supply and ammonia conversion and consequently determines the excess supply of ammonia. In the case of gas-nitiriding processes exceeding the processing time, constant, reproducible nitriding conditions can be set independently of the size of the surface of the component charge by means of controlling in accordance with the nitriding index.

In the case of low-pressure carbonitriding processes, a control in accordance with the nitriding index is not possible because the carbon and nitrogen concentration and thereby the carbon and nitrogen absorption constantly change on the component surface while the process is being carried out, whereby no constant, reproducible carburizing and nitriding conditions can be set when the nitriding index is held constant. The progression of the gas decomposition or respectively of the resulting reactions occurs as a function of pressure, temperature and as a function of the reactive or catalytically active surface of the component charge or furnace lining.

The residence time of the gases in the treatment chamber resulting from the rate of flow is therefore crucial for the atmospheric composition in said treatment chamber.

For this reason, solid gas quantities for carrying out the process are in practice empirically ascertained through an elaborate series of tests, said solid gas quantities however only apply to the tested charge structure, the treatment chamber and the material of the metal components which is used. A transfer of the solid gas quantities to other process implementations, materials, charge structures and treatment chambers is not directly possible. These would have to again be empirically ascertained. The German patent publication DE 101 18 494 C2 describes a low-pressure carbonitriding using solid gases.

SUMMARY OF THE INVENTION

The problem underlying the invention is solved by a method according to the invention as well as by a treatment chamber and an open-loop and/or closed-loop control device according to the invention. Important features for the invention are also found in the subsequent description and in the drawings, wherein the features can be of importance to the invention by themselves as well as in different combinations without explicit reference again being made to this fact.

By detecting a hydrogen content in a treatment chamber, the method according to the invention has the advantage of being able to carry out an even, reproducible carbonitriding using low-pressure carbonitriding on at least one component located in the treatment chamber independently of a charge size or a furnace unit.

According to the invention, a hydrogen content of a process gas atmosphere is monitored in the treatment chamber with the aid of a hydrogen sensor for the purpose of carbonitriding components. A carbon- or nitrogen-donating gas supply is thereby set or controlled using predefined limit values for the hydrogen content. This is based on the consideration that using the measured value of the hydrogen content, a carbon- or nitrogen-donating gas supply in the process gas atmosphere can be inferred independently of the structure of the component charge and/or the treatment chamber. Based on this inference, the quantity of the process gas flowing into the treatment chamber can be controlled with respect to point in time and/or period of time and/or quantity. The method can basically be used with a variety of components and is especially well suited for metallic components, in particular for iron-based materials. The use of the method is therefore described below with regard to metallic components.

In one process phase of the so-called "low-pressure carburization", for example using acetylene, a maximum hydrogen content in the process gas atmosphere ("atmosphere") of, for example, 75 vol % should not be exceeded. In a process phase, in which a nitrogen-donating gas, for example ammonia, is introduced into the treatment chamber, a maximum hydrogen content in the atmosphere of, for example, 50 vol % should not be exceeded due to the known nitrogen effusion. The advantage of the invention is that comparable carbon or nitrogen supplies are present locally at one or several metal components of a charge, and therefore a uniform carbon or nitrogen input into the surface(s) of the metal components is made possible. The method generally makes provision for the individual process phases to be carried out for any desired number and/or in any desired order.

In addition, the carbon or the nitrogen absorption changes during the processing time due to the already absorbed carbon or nitrogen and on account of the limited solubility of the two elements in the metallic matrix of the surfaces of the components. By means of the closed-loop control of the process or the process gas atmosphere with the aid of the hydrogen content detected by the hydrogen sensor, an unnecessarily high carbon or nitrogen supply can be prevented, whereby a process gas application which is efficient as possible and therefore a reduction in the processing costs are achieved.

The formation of toxic compounds, as e.g. cyanides, can be minimized or prevented by a monitoring of the process gas atmosphere, which is made possible by the detection of the hydrogen content. The treatment chamber is preferably evacuated or purged with an inert gas, such as nitrogen or argon in order to prevent a simultaneous presence, for example, of carbon- and nitrogen-donating gas. In so doing, undesired chemical reactions, as for example the formation of cyanides, can be prevented. The hydrogen content in the atmosphere of the treatment chamber, which was detected during the process gas exchange, can also be indirectly used as the measured value for the contents of the carbon- or nitrogen-donating gases. If a treatment chamber is purged with an inert gas during a process gas exchange, it can be assumed for hydrogen contents less than 5 vol %, preferably less than 1 vol %, that the concentrations of carbon- or nitrogen-donating gases are sufficiently small to adequately reduce or prevent environmental damage. If the treatment chamber is evacuated during a process gas exchange, it is required for a pressure in the treatment chamber of at least less than $1\times10^{-1}$ mbar, preferably less than $1\times10^{-2}$, to be undershot, whereby it can be assumed that the concentration of carbon- or nitrogen-donating gases is sufficiently small to adequately reduce or prevent environmental damage.

The method is especially simple to implement if a flow volume of the process gas introduced into the treatment chamber is controlled. For example, the quantity of the introduced process gas can be open-loop and/or closed-loop controlled by means of an adjustable valve at the inlet of the treatment chamber.

The method furthermore makes provision for the process gas to comprise a carbon-donating gas. In so doing, a first gas or a first gas composition for a process phase for the carbonitriding of components is provided, with which the carbon content important for the carbonitriding is directly influenced, a fast and precise open-loop or closed-loop control being thereby facilitated.

It is particularly favorable if the carbon-donating gas comprises a compound which is selected from a group consisting of acetylene, ethylene, propane, propylene, methane, hexanaphthene, cyclopentane or mixtures thereof. For this reason, a selection of commercially available and thereby comparatively inexpensive gases is available as the carbon-donating gas for implementing the method.

Provision is further made in the method for the process gas to comprise a nitrogen-donating gas. In so doing, a second gas or a second gas composition for a process phase for carbonitriding of components is provided, with which the nitrogen content important for the carbonitriding is directly influenced, a fast and precise open-loop or closed-loop control being thereby facilitated.

It is thereby favorable if the nitrogen-donating gas comprises a compound which is selected from a group consisting of ammonia, nitrogen or mixtures thereof. In so doing, a selection of commercially available and therefore inexpensive gases is available as the nitrogen-donating gas for implementing the method.

The method works especially advantageously if at least two chemically different process gases act chemically in succession on the one component and if the treatment chamber is at least partially evacuated between the gaseous process phases. As a result of the different gas compositions, which act successively in different process phases on the at least one component—that is to say, for example, a carbon-donating gas and a nitrogen-donating gas—chemical effects with respect to the method can in each case be achieved. Here it is useful not to mix these gas compositions with each other when a change in the process phases occurs. This can be simply achieved by at least partially evacuating the treatment chamber.

Provision is alternatively made for at least two chemically different process gases to chemically act in succession on the component and for the treatment chamber to be purged with an inert gas between the gaseous process phases. In so doing, the change between two gaseous process phases can occur, wherein the prevailing pressure in the treatment chamber can substantially remain unchanged.

The method according to the invention furthermore makes it possible for the purging or evacuating of the treatment chamber to end if the detected hydrogen content or the overall pressure of the atmosphere does not meet a predefined threshold value. The detection of the hydrogen content can thereby also be used between the process phases in order to ascertain the effect of the evacuation or the purging. Unwanted chemical reactions can thereby be prevented and the quantity of the required purging gas or the strength and/or duration of the evacuation can be limited.

Provision is made in one embodiment of the method for two process phases having a similar process gas to be implemented and for an evacuation or purge to be carried out between the two process phases. In this way, a so-called diffusion phase is set up between said two process phases.

Provision is made in a further embodiment of the method for two process phases having a similar process gas to be implemented and for a process gas not to be delivered to the treatment chamber and an evacuation or purge not to be carried out between the two process phases. In this way, a diffusion phase is set up between said two process phases, in which the process gas still remaining in the treatment chamber can continue to remain reactively active on the component surface.

The method works especially effectively if the treatment chamber, the process gas and/or the atmosphere are heated. The desired chemical reactions on the surfaces of the components generally take place more intensively and faster at higher temperatures of the atmosphere resulting in the treatment chamber. The treatment chamber can thereby itself be heated or heated up as well as a heater situated therein, the atmosphere and/or the process gas fed thereto.

Provision is made in one embodiment of the method for the treatment temperature to lie in a range between 750° C. to 1050° C. A favorable temperature range is thereby specified for many applications.

In addition, the method provides for the flow volume of the carbon-donating gas to be dropped to such an extent that a soot formation inside of the atmosphere of the treatment chamber is reduced or prevented. In this way, the hydrogen content ascertained can advantageously be used to reduce or prevent sooting of the treatment chamber or the elements or components situated therein.

BRIEF DESCRIPTION OF THE DRAWINGS

Further advantages and advantageous embodiments of the method according to the invention or the devices according to the invention are illustrated by means of the drawings and explained in the description below. It should thereby be noted that the drawings serve only a descriptive purpose and are not to be considered in a way that limits the invention in any manner. In the drawings.

DETAILED DESCRIPTION

Figure 1:
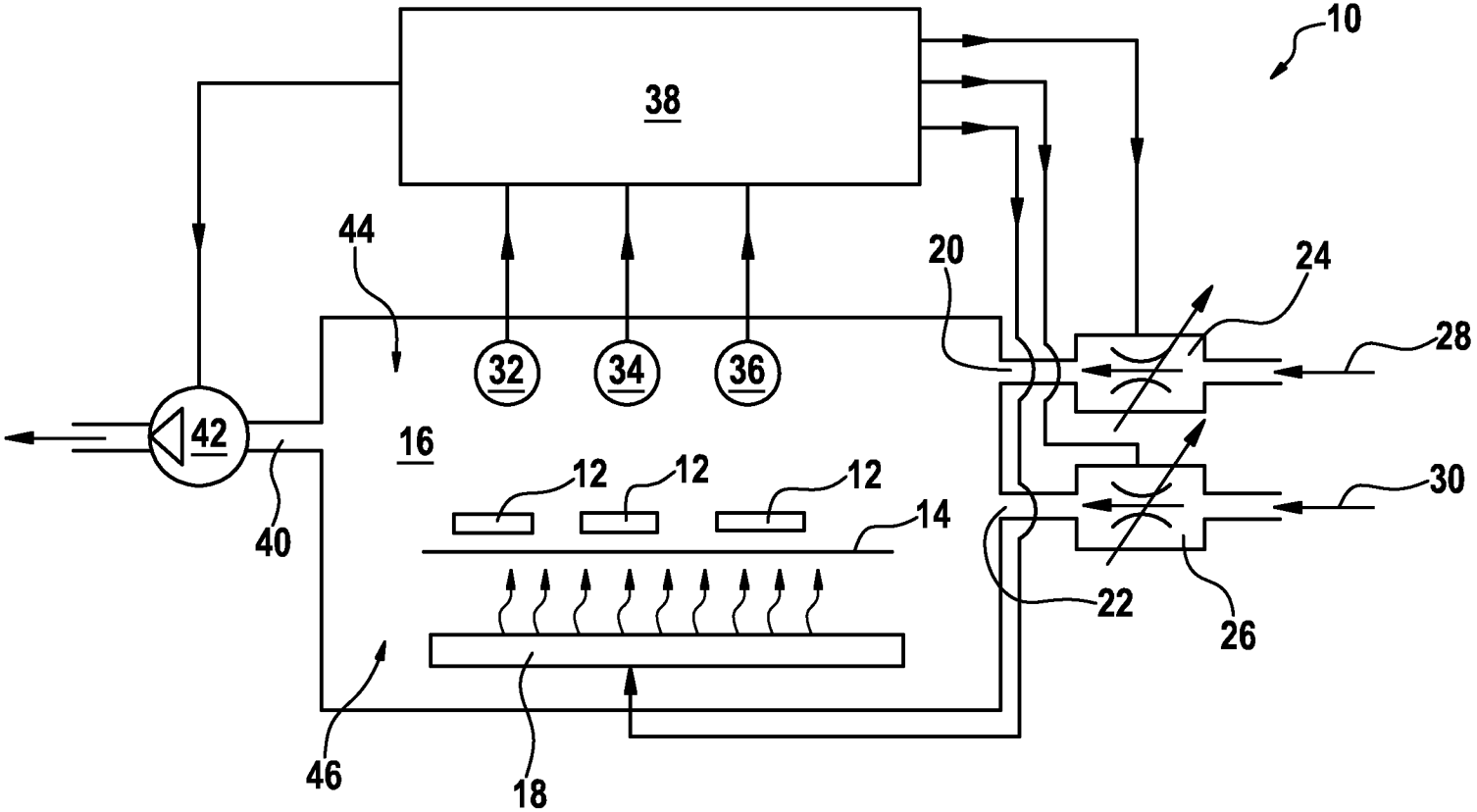
FIG. 1 shows a schematic view of a treatment chamber for low-pressure carbonitriding of components.

The same reference numerals are used for functionally equivalent elements and sizes in all of the figures even when the embodiments are different.

FIG. 1 shows a schematic view of a layout 10 for the low-pressure carbonitriding of metallic components 12, which are disposed on a support plate 14 in a treatment chamber 16. The components 12 can be heated up by means of a heating device 18 situated in the lower region of the drawing. A first inlet 20 and a second inlet 22 having associated flow control valves 24 and 26 facilitate the introduction of carbon-donating gas 28 and nitrogen-donating gas 30. A temperature sensor 32, a pressure sensor 34 and a hydrogen sensor 36 suitable for the low-pressure carbonitriding are disposed in the drawing in the upper region of the treatment chamber 16. An open-loop and/or closed loop control device 38, which is depicted above the aforementioned sensors receives among other things signals coming from the temperature sensor 32, the pressure sensor 34 and the hydrogen sensor 36. An outlet 40 of the treatment chamber 16 leads to the entrance of a pump 42.

During operation, the carbon-donating gas 28 or the nitrogen-donating gas 30 is successively introduced in different process phases into the treatment chamber 16 by means of the flow control valves 24 and 26. The open-loop and/or closed-loop control device 38 monitors and controls in an open loop or in a closed-loop among other things the process or rather the individual process phases using the sensors 32, 34 and 36. A hydrogen content 44, which is detected by the hydrogen sensor 36 and which results in an atmosphere 46 of the treatment chamber 16, is particularly important as will be explained further in regard to the following FIGS. 2 and 3. The pump 42 acts simultaneously as a valve at the outlet 40 and is actuated in a process-oriented manner to partially evacuate the treatment chamber 16 or to let out or exchange the gases situated therein. The flow control valves 24 and 26 are controlled among other things by the open-loop and or closed-loop control device 38 as a function of hydrogen content 44 detected by the hydrogen sensor 32.

Figure 2:
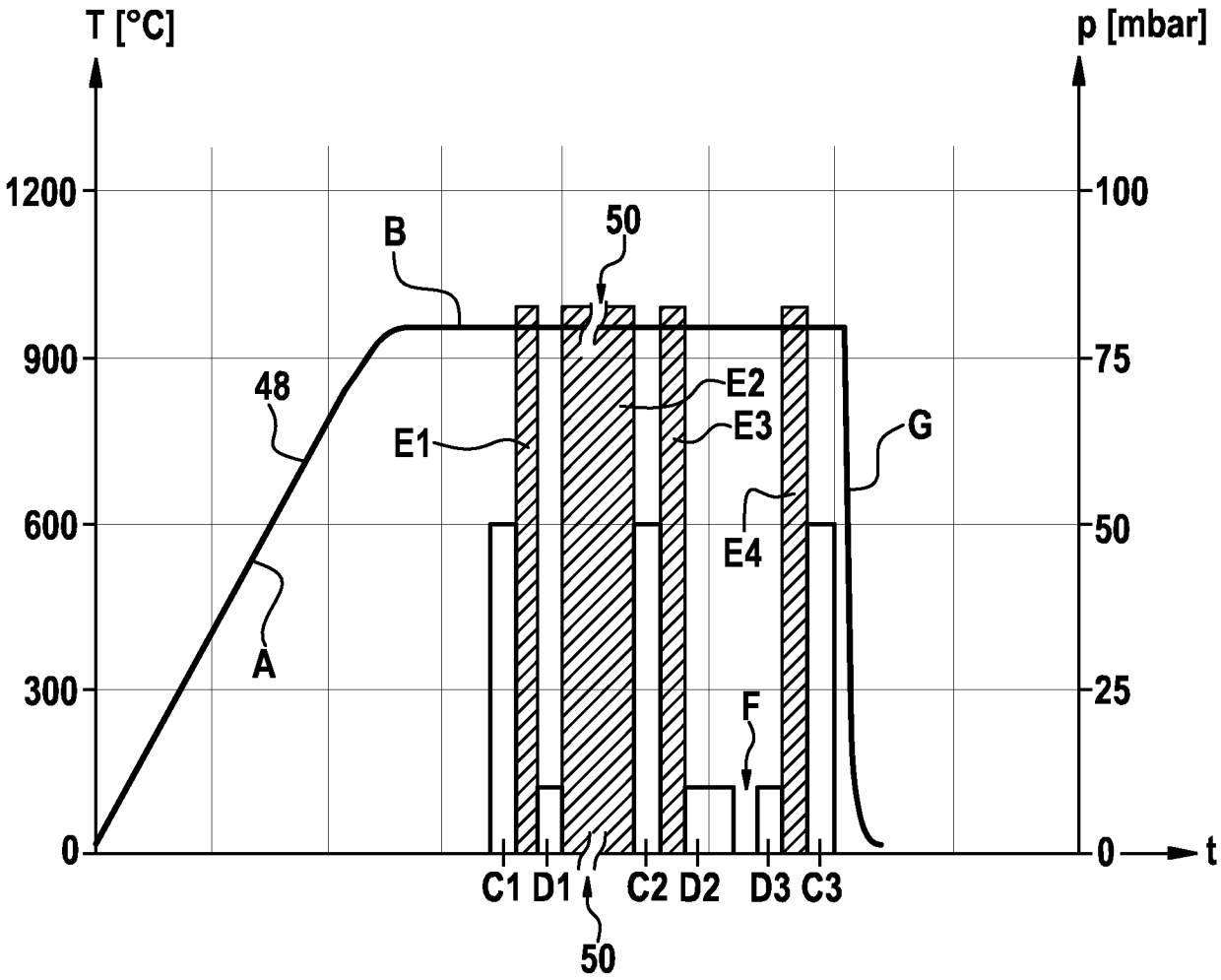
FIG. 2 shows a time diagram of a low-pressure carbonitriding method comprising a depiction of process phases and process temperatures.

A time diagram of a process implementation of a low-pressure carbonitriding is depicted in FIG. 2, said diagram, for example, being used in the layout 10 shown in FIG. 1. The time t is plotted on the abscissa of the diagram and the temperature T of the atmosphere 46 on the ordinate. A curve 48 shows the temporal profile of the temperature T. The low-pressure carbonitriding comprises a heating-up phase A, a temperature equalization phase B, three nitriding phases C1, C2 and C3, three carburizing phases D1, D2 and D3, four process gas exchange phases E1, E2, E3 and E4 as well as a diffusion phase F and a cooling-down phase G. Two discontinuities 50 indicate that the process phases that are depicted do not have to have the respectively designated durations but can also deviate as desired from the depiction of FIG. 2.

The difference between the diffusion phase F and the process gas exchange phases designated by the reference numerals E1 to E4 is that the detected hydrogen content 44 is used during the process gas exchange phases E1 to E4 to monitor and thus to reduce or prevent undesirable reaction products, as e.g. cyanide, wherein a process gas is not fed and a process gas exchange does not take place. The process or the method can therefore be interrupted in the case of a malfunction, e.g. if the pump 42 or the flow control valves 24 and 26 break down in order to reduce or eliminate a danger to the environment. In the entire depicted time period of FIG. 2, the hydrogen content 44 is detected by the hydrogen sensor 36 and used for the process control.

FIG. 2 shows that during the heating-up phase A, the temperature T with an approximately constant heat-up rate is continually increased up to a treatment temperature of approximately 950°. The temperature T is thus located in an optimal range of 750° C. to 1050° C.

In the temperature equalization phase B subsequent to the heating-up phase A, the treatment temperature is constantly maintained at approximately 950° C. Neither a nitrogen-donating gas 30 nor a carbon-donating gas 28 is supplied during the heating-up phase A and the temperature equalization phase B.

In the first nitriding phase C1 immediately subsequent to the temperature equalization phase B, a nitrogen-donating gas 30, for example ammonia, having a nitrogen-donating gas partial pressure of approximately 50 mbar is supplied. This is displayed on the right vertical axis of the diagram of FIG. 2. Thereafter a first process gas exchange E1, in which the treatment chamber 16 is evacuated or purged with an inert gas, e.g. nitrogen or argon, takes place. In this process phase, the overall pressure in the treatment chamber 16 or the detected hydrogen content is used for the purpose of monitoring the still remaining content of the nitrogen-donating gas 30 from the nitriding phase C1 in order to be able to reduce or prevent environmentally damaging reaction products such as, for example, cyanide during the subsequent carburizing phase D1. If the treatment chamber 16 is purged during the process gas exchange phase E1 with an inert gas and if the hydrogen content 44 is smaller than 5 vol % ideally smaller than 1 vol %, the carburizing phase D1 can begin. If the treatment chamber 16 is evacuated during the process gas exchange phase E1 and the overall pressure of said treatment chamber 16 becomes less than $1\times10^{-1}$, ideally less than $1\times10^{-2}$, the carburizing phase D1 can begin. Otherwise a warning indication is produced by the open-loop and/or closed-loop control device 38 and an intervention by the unit's operator must take place.

A carburizing phase D1, which has a partial pressure of the carbon-donating gas 28 of approximately 10 mbar, follows the first process gas exchange E1.

Further implementation of the process is carried out analogously, wherein a diffusion phase F without a process gas exchange takes place between the two carburinzing phases D2 and D3. The treatment chamber 16 is evacuated in the diffusion phase F or alternatively purged with an inert gas, e.g. nitrogen or argon.

After the last nitriding phase C3, the temperature T of the atmosphere 46 (treatment temperature) of 950° C. is no longer maintained and a swift cooling down to room temperature is carried out in the cool-down phase G in order to set the desired structural composition of the metallic components 12.

It goes without saying that numerous methods for controlled carbonitiriding or controlled low-pressure carbonitriding are possible and the invention is not limited to the sequence and number of three nitriding phases C1, C2 and C3, three carburizing phases D1, D2 and D3, four process gas exchanges E1, E2, E3 and E4 as well as a diffusion phase F as presented in FIG. 2.

Figure 3:
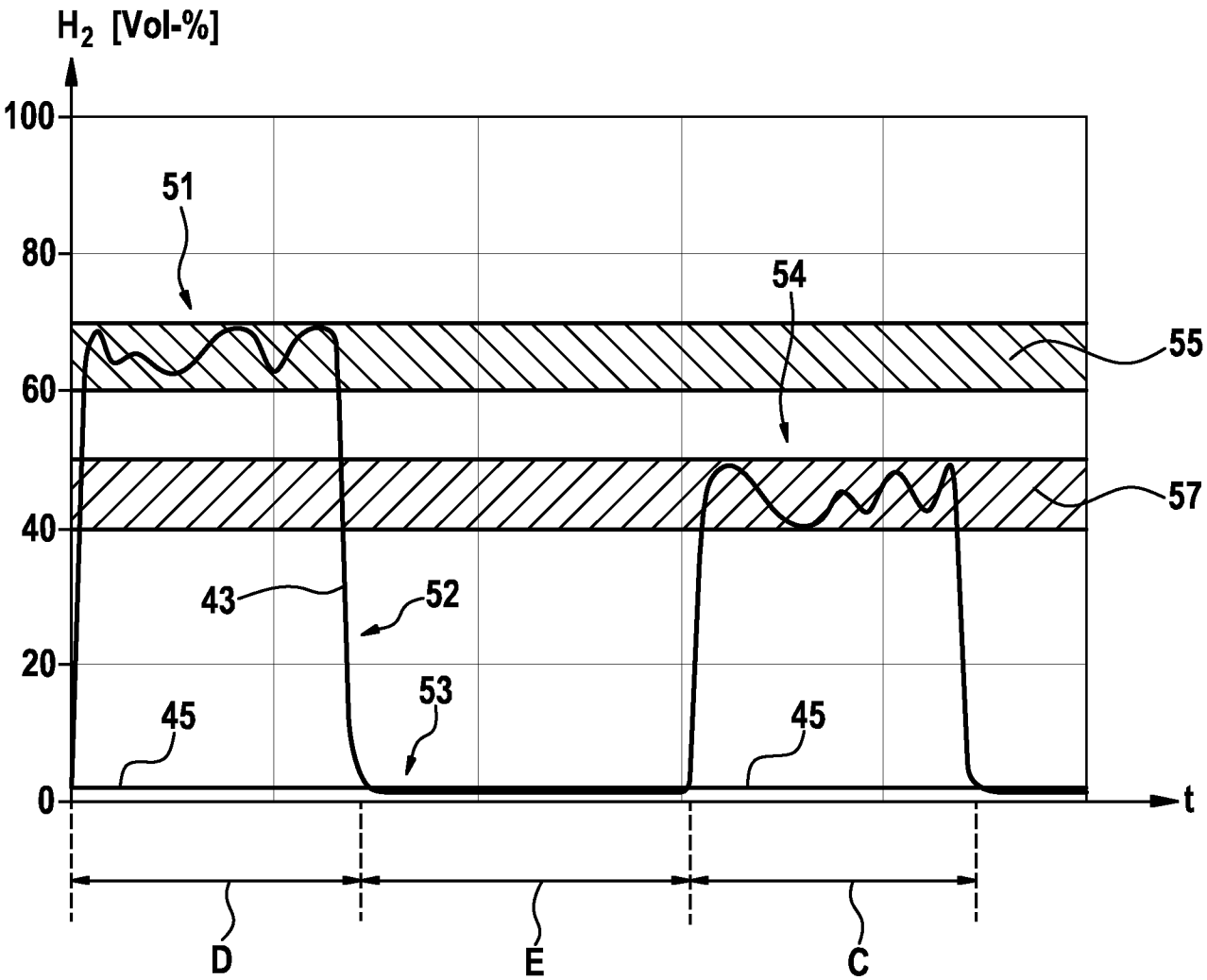
FIG. 3 shows a time diagram of the low-pressure carbonitriding method comprising a depiction of a hydrogen content in an atmosphere of the treatment chamber.

In FIG. 3, a time diagram for controlling a carbon- and nitrogen-donating gas supply during a carburizing phase D and a subsequent nitriding phase is depicted. The abscissa of the diagram of FIG. 3 depicts the time t and the ordinate depicts the volumetric content of the hydrogen ($H_2$) in vol %. The scale covers thereby the range from 0% to 100%. A curve 43 then reflects the temporal profile of the hydrogen content 44. A horizontal line indicates a threshold value 45 for the hydrogen content 44. A process gas exchange phase E occurs after the carburizing phase D and prior to the nitriding phase C.

At the start of the carburizing phase D, carbon-donating gas 28 is introduced into the treatment chamber 16. As a result of the breakdown of the carbon-donating gas 28 on the surface of one or a plurality of metallic components 12, hydrogen is released and the measured hydrogen content 44 in the atmosphere 46 (process gas atmosphere) consequently increases. At the same time, the content of the carbon-donating gas 28 in the treatment chamber 16 drops. In order to prevent an uneven carburizing of one or a plurality of metallic components 12 as a result of too small a content of carbon-donating gas 28, the content of said carbon-donating gas 28 is, for example, adjusted or controlled by varying the flow control valve 24. This is depicted in FIG. 3 by an arrow 51. A range provided in FIG. 3 for the hydrogen content 44 extends between 60 vol % and 70 vol %.

Following the carburizing phase D, the treatment chamber 16 is evacuated or purged with an inert gas, e.g. nitrogen or argon. This is illustrated by an arrow 52. The measured hydrogen content 44 (arrow 53) is thereby reduced. If said hydrogen content 44 falls under 5 vol %, ideally under 1 vol %, when purging with an inert gas under 5 vol %, ideally under 1 vol %, during the process gas exchange phase E or the overall pressure becomes less than $1\times10^{-1}$ mbar, ideally less than $1\times10^{-2}$ when evacuating the treatment chamber during the process gas exchange phase E, the nitriding phase C can begin. This is depicted by the arrow 54.

At the start of the nitriding phase C, nitrogen-donating gas 30 is introduced into the treatment chamber 16. As a result of the breakdown of the nitrogen-donating gas 30 on the surface of one or a plurality of metallic components 12, hydrogen is released and consequently the measured hydrogen content 44 increases in the atmosphere 46. At the same time, the content of the nitrogen-donating gas 30 drops in the treatment chamber 16. In order to prevent an uneven nitriding of one or a plurality of metallic components 12 as a result of too small a content of nitrogen-donating gas 30, the flow capacity of the nitrogen-donating gas 30 is controlled by means of the flow control valve 26 with the aid of the detected hydrogen content 44, cf. FIG. 1. This takes place in FIG. 3 in the section indicated by the arrow 54, which has a range 57 for the hydrogen content 44 between 40 vol % and 50 vol %. The control of the nitrogen-donating gas flow capacity on the basis of the measured hydrogen content 44 therefore ensures an even nitriding of one or a plurality of metallic components. After the nitriding has taken place, the treatment chamber 16 is either evacuated or purged with a suitable inert gas.

It goes without saying that in this manner, numerous methods for controlled nitriding are possible and the invention is not limited to the sequence and number of a carburizing phase, a process gas exchange and a nitriding phase, which are explained in FIG. 3.

The invention claimed is:

1. A method for carbonitriding at least one component (12) in a treatment chamber (16), comprising introducing a process gas (28; 30) comprising a carbon-donating gas and a process gas comprising a nitrogen-donating gas into the treatment chamber (16), detecting a hydrogen content (44) in an atmosphere (46) developing in said treatment chamber (16) as a by-product from the process gas comprising a carbon-donating gas and/or the process gas comprising a nitrogen-donating gas and maintaining the hydrogen content in a desired range (55; 57) at least temporarily by influencing the amount of the process gas comprising a carbon-donating gas and/or the amount of the process gas comprising a nitrogen-donating gas that is fed, wherein at least two chemically different process gases (28, 30) act chemically in succession on the component (12) and wherein an evacuation or purge of the treatment chamber is completed when the detected hydrogen content (44) of the atmosphere (46) undershoots a predefined threshold value (45).

2. The method according to claim 1, characterized in that the carbon-donating gas comprises a compound, which is selected from a group consisting of acetylene, ethylene, propane, propylene, methane, hexanaphthene, cyclopentane and mixtures thereof.

3. The method according to claim 1, characterized in that the nitrogen-donating gas comprises a compound, which is selected from a group consisting of ammonia, nitrogen and mixtures thereof.

4. The method according to claim 1, characterized in that the treatment chamber (16) is at least partially evacuated between gaseous process phases (D; C).

5. The method according to claim 1, characterized in that the treatment chamber (16) is purged with an inert gas between gaseous process phases (D; C).

6. The method according to claim 1, characterized in that the treatment chamber (16), at least one of the process gas comprising a carbon-donating gas, the process gas comprising a nitrogen-donating gas, and the atmosphere (46) is heated.

7. The method according to claim 1, characterized in that an operating temperature (T) lies in a range from 750° C. to 1050° C.

8. The method according to claim 1, characterized in that a flow volume of the carbon-donating gas (28) is dropped to such an extent that a soot formation within the atmosphere (46) of the treatment chamber (16) is reduced or prevented.

9. A method for carbonitriding at least one component in a treatment chamber, comprising introducing a process gas comprising a carbon-donating gas and a process gas comprising a nitrogen-donating gas into the treatment chamber, detecting a hydrogen content in an atmosphere developing in said treatment chamber as a by-product from the process gas comprising a carbon-donating gas and/or the process gas comprising a nitrogen-donating gas and maintaining the hydrogen content in a desired range at least temporarily by influencing the amount of the process gas comprising a carbon-donating gas and/or the amount of the process gas comprising a nitrogen-donating gas that is fed, characterized in that an evacuation or purge of the treatment chamber is carried out between the two process phases.

10. A method for carbonitriding at least one component (12) in a treatment chamber (16), comprising introducing a process gas (28; 30) comprising a carbon-donating gas and a process gas comprising a nitrogen-donating gas into the treatment chamber (16), detecting a hydrogen content (44) in an atmosphere (46) developing in said treatment chamber (16) as a by-product from the process gas comprising a carbon-donating gas and/or the process gas comprising a nitrogen-donating gas and maintaining the hydrogen content in a desired range (55; 57) at least temporarily by influencing the amount of the process gas comprising a carbon-donating gas and/or the amount of the process gas comprising a nitrogen-donating gas that is fed, wherein at least two chemically different process gases (28; 30) act chemically in succession on the component (12) and wherein an evacuation or purge of the treatment chamber is completed when the detected hydrogen content (44) of the atmosphere (46) undershoots a predefined threshold value (45).

* * * * *